US012378024B2

(12) United States Patent
Bortolazzi

(10) Patent No.: US 12,378,024 B2
(45) Date of Patent: Aug. 5, 2025

(54) APPARATUS AND METHOD FOR FORMING A HERMETIC PACKAGE FOR CREAMY PRODUCTS

(71) Applicant: I.M.A. INDUSTRIA MACCHINE AUTOMATICHE S.p.A., Ozzano Dell'Emilia (IT)

(72) Inventor: Giuseppe Bortolazzi, Ozzano Dell'Emilia (IT)

(73) Assignee: I.M.A. Industria Macchine Automatiche S.p.A., Ozzano Dell'Emilia (IT)

( * ) Notice: Subject to any disclaimer, the term of this patent is extended or adjusted under 35 U.S.C. 154(b) by 539 days.

(21) Appl. No.: 17/790,005

(22) PCT Filed: Feb. 9, 2021

(86) PCT No.: PCT/IB2021/051020
§ 371 (c)(1),
(2) Date: Jun. 29, 2022

(87) PCT Pub. No.: WO2021/161156
PCT Pub. Date: Aug. 19, 2021

(65) Prior Publication Data

US 2023/0045208 A1 Feb. 9, 2023

(30) Foreign Application Priority Data

Feb. 10, 2020 (IT) ..... 102020000002494

(51) Int. Cl.
*B65B 7/28* (2006.01)
*B65B 3/02* (2006.01)
(Continued)

(52) U.S. Cl.
CPC ..... *B65B 25/068* (2013.01); *B65B 3/02* (2013.01); *B65B 7/28* (2013.01); *B65B 25/10* (2013.01); *B65D 85/76* (2013.01)

(58) Field of Classification Search
CPC ..... B65B 25/068; B65B 25/10; B65B 3/02; B65B 7/28; B65D 85/76
See application file for complete search history.

(56) References Cited

U.S. PATENT DOCUMENTS 3,924,803 A * 12/1975 de Habsburg ..... B65D 75/28 426/123
11,097,859 B2 * 8/2021 Vernier ..... B65D 85/76
(Continued)

FOREIGN PATENT DOCUMENTS

GB 929141 A * 6/1963 ..... B65B 5/028
WO WO-9935057 A1 * 7/1999 ..... B65B 25/10

OTHER PUBLICATIONS

International Search Report and Written Opinion dated Apr. 15, 2021 from counterpart International Patent Application No. PCT/IB2021/051020.

*Primary Examiner* — Andrew M Tecco
(74) *Attorney, Agent, or Firm* — SHUTTLEWORTH & INGERSOLL, PLC; Timothy J. Klima

(57) ABSTRACT

A method for forming a package for creamy products including the following steps: the formation of a tray starting from a first piece of wrapping material in such a way as to form a base and a continuous perimeter edge perpendicular to the base; dosing a predetermined quantity of creamy product into the tray formed; forming a lid for closing the upper opening of the tray starting from a second piece of wrapping material and positioning the lid formed in contact with the creamy product; the second piece has a surface for covering the creamy product and a raised perimeter edge extending from the covering surface and positioned to face
(Continued)

the perimeter edge of the tray; a sealing of the package by sealing the lid to the tray obtained by partial sealing of the perimeter edges placed side by side of the tray and of the lid to the tray in such a way as to define at least a first perimeter zone of the edges sealed together and at least a second perimeter zone of the edges which are not sealed and communicating with the creamy product contained in the tray; a folding of the facing perimeter edges on the covering surface of the lid; a subsequent step of expelling any air present in the tray by pressing on the creamy product contained in the tray; and lastly a complete sealing of the folded perimeter edges in such a way as to define a complete sealing of the package obtained.

15 Claims, 6 Drawing Sheets

(51) Int. Cl.

| | |
|---|---|
| ***B65B 25/06*** | (2006.01) |
| *B65B 25/10* | (2006.01) |
| *B65D 85/76* | (2006.01) |

(56) References Cited

U.S. PATENT DOCUMENTS

| | | | | |
|---|---|---|---|---|
| 12,208,933 | B2 * | 1/2025 | Holka | B31F 1/009 |
| 2018/0118382 | A1 * | 5/2018 | Vernier | B65D 85/76 |

* cited by examiner

APPARATUS AND METHOD FOR FORMING A HERMETIC PACKAGE FOR CREAMY PRODUCTS

This application is the National Phase of International Application PCT/IB2021/051020 filed Feb. 9, 2021, which designated the U.S.

This application claims priority to Italian Patent Application No. 102020000002494 filed Feb. 10, 2020, which application is incorporated by reference herein.

TECHNICAL FIELD

This invention relates to an apparatus and a method for forming a package for creamy products, that is, with a creamy consistency such as products derived from milk, such as cheeses.

BACKGROUND ART

Currently, the sealed packages of creamy products, in particular processed cheese, are of different geometrical types, such as a polygonal solid with a square, rectangular or triangular base, but also with a circular base and are all obtained by a method which comprises:

- forming a tray starting from a first piece of wrapping material (flat), which is folded in such a way as to define a base and at least one continuous perimeter edge with an extension perpendicular to the base;
- dosing a predetermined quantity of processed cheese inside the tray;
- closing the upper opening of the tray with a second piece of wrapping material positioned in contact with the creamy product;
- folding the free edges of the tray on the second piece; and
- hot sealing the perimeter edges of the package.

The first and second pieces of wrapping material are made from metal films, such as, for example, aluminium, but the material which can be used may be different even though with properties similar to metal films.

The second piece of wrapping material for closing the tray is currently prepared with two different operational methods.

In a first solution for dosing the tray, the second piece with a flat extension is positioned above the product and inside the tray in such a way that free edges of the tray protrude from the perimeter.

The package is closed by folding the free edges (on the inner side, that is, the one in contact with the processed cheese) of the tray towards the second piece (on the outer side, that is to say, opposite the one in contact with the processed cheese) placed and then sealing the folded edges onto the second piece of covering.

It is understood that during the sealing step, as a consequence also of the type of product, which is semi-liquid and therefore not fully stable during packaging operations, some zones of the edges joining the two components may have folds which are able to form gaps which can generate, once the closure process has been completed, extremely small slits which, when the package is closed, may adversely affect the hermetic seal of the package.

This problem of the absence of a hermetic seal may worsen with the increase in the size of the package to be formed and hence the high perimeter of the closure.

In a second solution for closing the tray (of particular relevance for this invention), the second piece is firstly formed with a base and a continuous perimeter edge perpendicular to the base (in the same way as the tray) and then positioned above the product inside the tray (closing the free opening of the tray) in such a way as to have the edges of the second piece (on the inner side) facing the free edges (on the inner side) of the tray.

At this point, the two facing edges in contact are joined over the entire perimeter by sealing and then folded together towards the inside of the tray.

These packages are made from automatic apparatuses comprising:

- a station for feeding individual pieces of wrapping material;
- a hopper for forming the open tray;
- a conveyor (with a linear or circular path) equipped with a plurality of open cavities or seats in which corresponding open trays are positioned to allow the trays to reach in sequence:
- a filling station having a device for dispensing the product configured for depositing a predetermined dose of product in the tray;
- a station for closing the tray comprising a unit for forming and depositing the second piece of wrapping material on the tray, a unit for sealing the edges alongside each other of the tray and of the second piece of wrapping material and a folding unit configured to fold the edges joined so as to adhere to the outer surface of the second piece in such a way as to form the final package.

Although this second solution allows an adequate hermetic seal to be obtained, it does not guarantee an optimum duration of the product in the package if air bubbles are trapped.

AIM OF THE INVENTION

The aim of this invention is to provide an apparatus and a method for forming a package for creamy products, that is to say, with a creamy consistency like products derived from milk, such as cheeses, which overcome the above-mentioned disadvantages of the prior art.

More specifically, the aim of the invention is to provide an apparatus and a method for forming a package for creamy products which is able to reduce the risks of lack of hermetic seal and eliminate, at the same time, the risk of entrapping air in the package.

A further aim of the invention is to provide an apparatus and a method for forming a package for creamy products which is able to maintain a high rate of quality of the finished product combined with a high level of operating flexibility irrespective of the shape of the package.

Said aims are fully achieved by the apparatus and method for forming a package for creamy products according to the invention as characterised in the appended claims.

BRIEF DESCRIPTION OF THE DRAWINGS

The features of the invention will become more apparent from the following detailed description of a preferred, non-limiting embodiment of it, illustrated by way of example in the accompanying drawings, in which.

DETAILED DESCRIPTION OF PREFERRED EMBODIMENTS OF THE INVENTION

With reference to the accompanying drawings, in particular FIGS. 1 to 6 and 9 to 16, the method according to the invention and the relative apparatus implementing the method are used for forming a package, shown in some of these drawings and labelled 1 in its entirety, for creamy products, such as, for example, but without limiting the scope of the invention, processed cheese.

Figure 1:
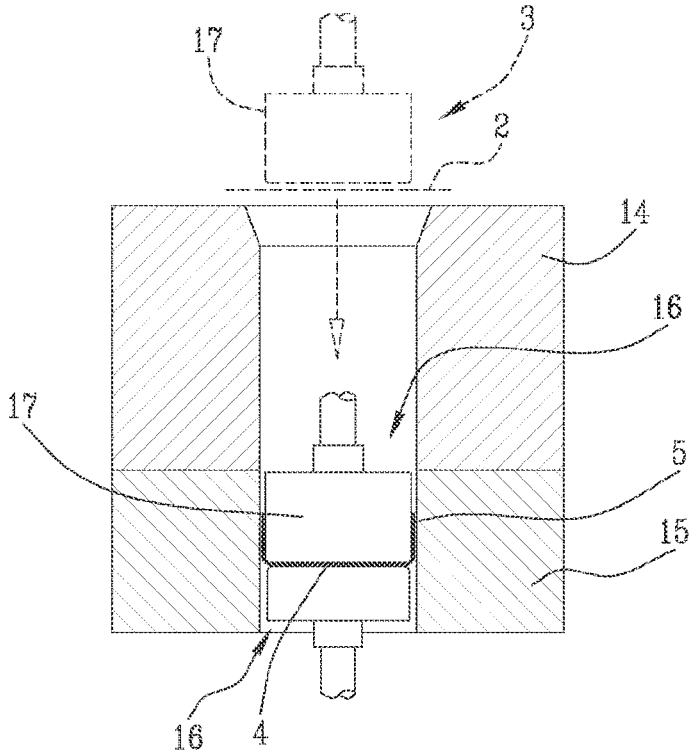
FIGS. 1 to 6 are schematic side views partly in cross section and with some parts cut away to better illustrate others of a sequence of steps defining a method for forming a package for creamy products, according to the invention, and the apparatus which implements the method.
Figure 9:
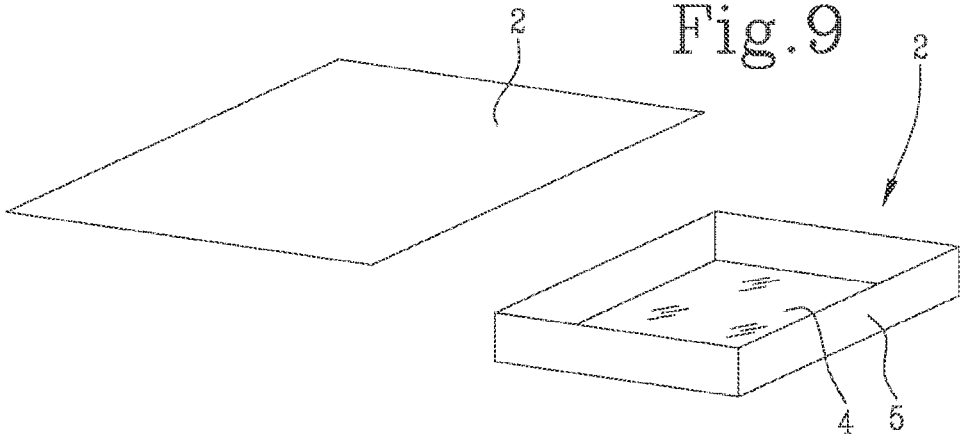
FIGS. 9 to 13 and from 14 to 16 illustrate schematic perspective views of the steps described in FIGS. 1 to 6.

As illustrated, the method comprises a step for forming a tray starting from a first piece 2 of wrapping material (using a first forming device 3) folding the first piece 2 in such a way as to form a base 4 and a continuous perimeter edge 5 extending substantially perpendicular to the base 4 (FIGS. 1 and 9).

The tray is cup-shaped, with an upper opening facing upwards. In a quadrangular configuration, the perimeter edge 5 is formed by four vertical walls which extend from the base 4. The four vertical walls and the base 4 are formed starting from a single piece 2 of wrapping material.

Figure 2:
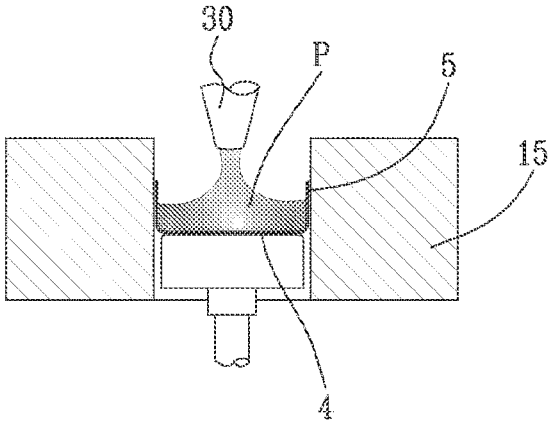
Figure 10:
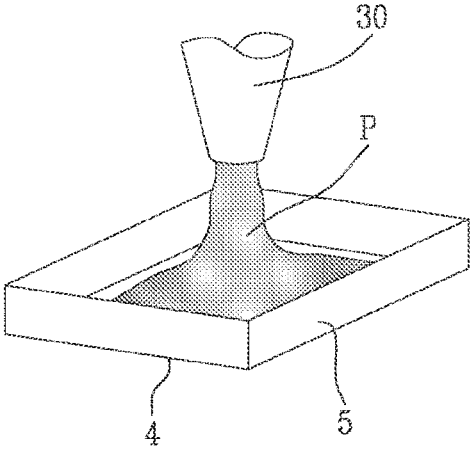

Subsequently, the method comprises a step of dosing a predetermined quantity of creamy product P into the tray formed (FIGS. 2 and 10).

The quantity of product dosed into the tray formed is such as to leave, in the upper part, a free perimeter edge 5 not struck by the creamy product P.

Figure 3:
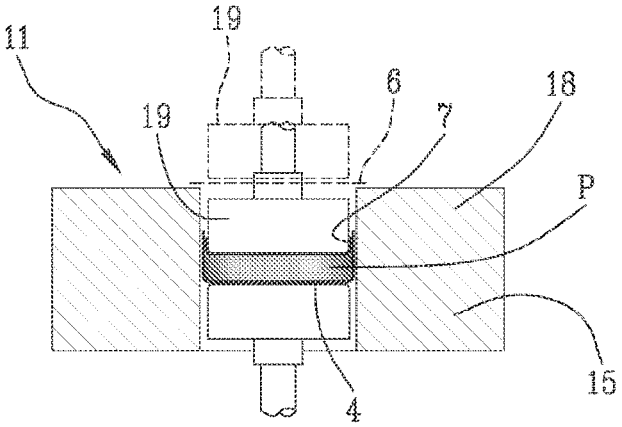
Figure 11:
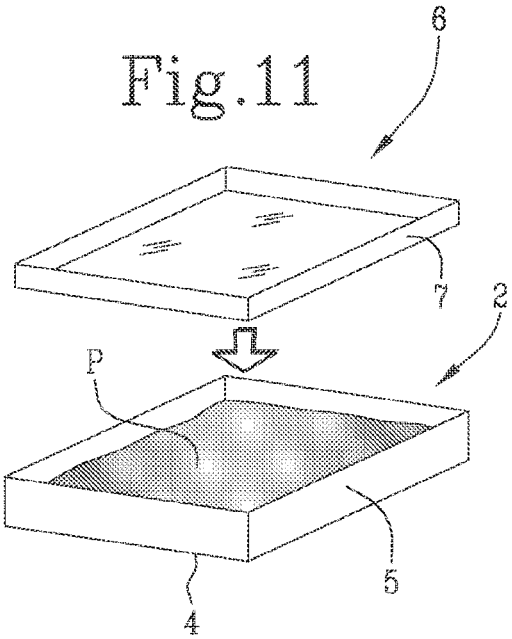
Figure 12:
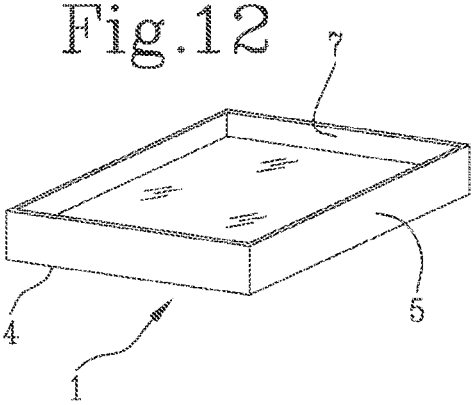

Again as illustrated, the method comprises a step for forming a lid for closing the top opening of the tray starting from a second piece 6 of wrapping material folding the second piece 6 in such a way as to define a covering surface and a raised perimeter edge 7 which extends substantially perpendicular from the covering surface;

The method also comprises a step of inserting the dosing lid into the tray placing the covering surface in contact with the creamy product P positioned in the tray and the raised perimeter edge 7 of the lid facing the perimeter edge 5 of the tray (see FIGS. 3, 11 and 12).

In practice, the lid 6 is made in the same way as the tray.

More specifically, defining as an inner side of the first and second piece the side in contact with the product and the outer side of the first and second piece the side opposite the inner side, the edge 7 of the lid and the free edge 5 of the tray have both the relative inner sides facing each other.

The method comprises a step of sealing the package 1 by sealing the lid to the tray.

As illustrated, the step of sealing the package 1 comprises the following sub-steps:

- a partial sealing of the perimeter edges 5 and 7 facing each other of the tray and of the lid 6 in such a way as to define at least a first perimeter zone Z1 of the edges 5 and 7 sealed to each other and at least a second perimeter zone Z2 of the edges 5 and 7 not sealed and communicating with the creamy product contained in the tray (see FIGS. 4, 7 and 13 and 13*a*).

Figure 5:
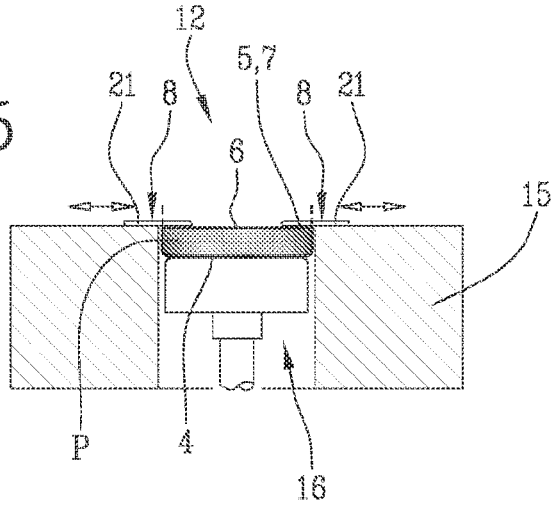
Figure 6:
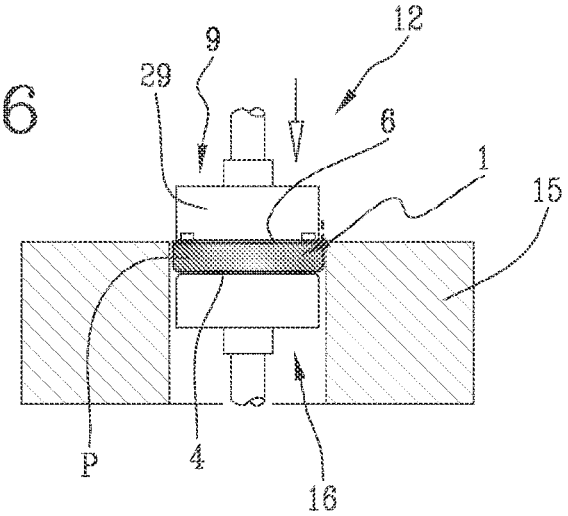
Figure 14:
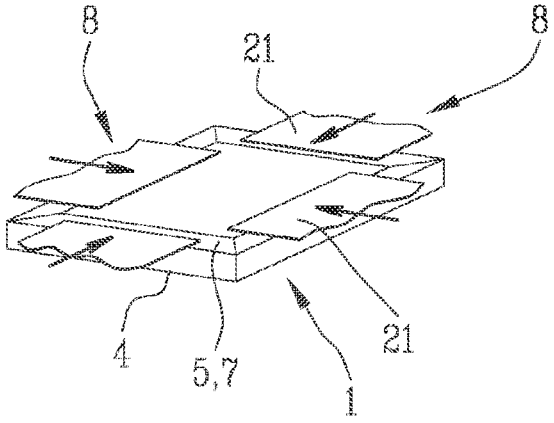
Figure 15:
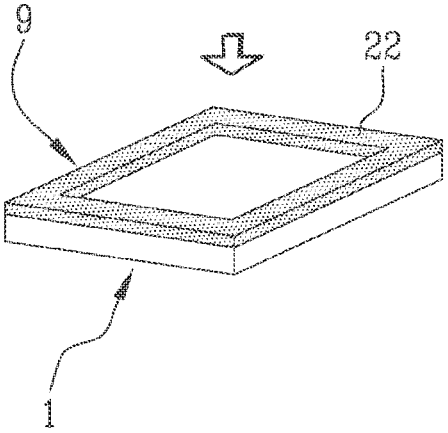
Figure 16:
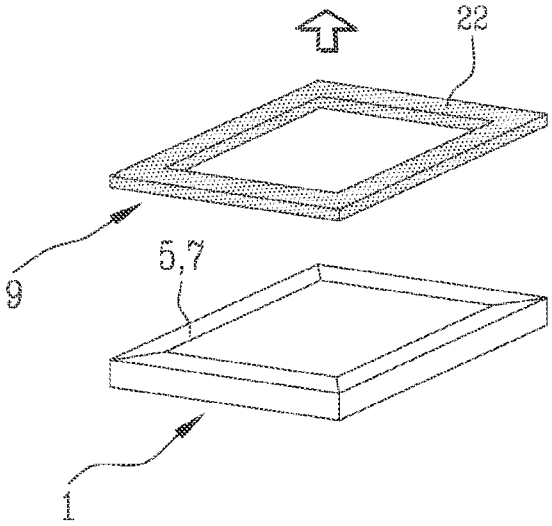

After the partial sealing step, the method comprises the following sub-steps:

- folding the facing (and partly sealed) perimeter edges 5 and 7 of the tray and the lid 6 on the covering surface of the lid (see FIGS. 5 and 14);
- a subsequent step of expelling any air present in the tray by pressing on the product contained in the tray; and lastly
- a step of pressing the creamy product P contained in the partly sealed tray for expelling any air present in the tray;
- a final sealing of the perimeter edges 5 and 7 folded on the covering surface of the lid 6 in such a way as to obtain a complete sealing of the package 1 obtained (see FIGS. 6, 15 and 16).

Thanks to this method for forming the package, a package is obtained which has both an optimum seal with consequent better hermetic properties and a package without air bubbles inside it which might adversely affect the life of the product located in the closed package.

Preferably, the sub-step of expelling air and the sub-step of complete sealing are carried out almost simultaneously by means of a single sealing/pressing device 9 (see FIG. 6).

It should be noted that the edges 5 and 7 of the lid 6 and of the tray may have different heights where they face each other.

In light of this, the step of forming the closing lid 6 (of the upper opening of the tray) forms a perimeter edge 7 of the lid 6 with a height such that when it is rested on the creamy product P inside the tray, it is placed over the perimeter edge 5 of the tray.

Figure 7:
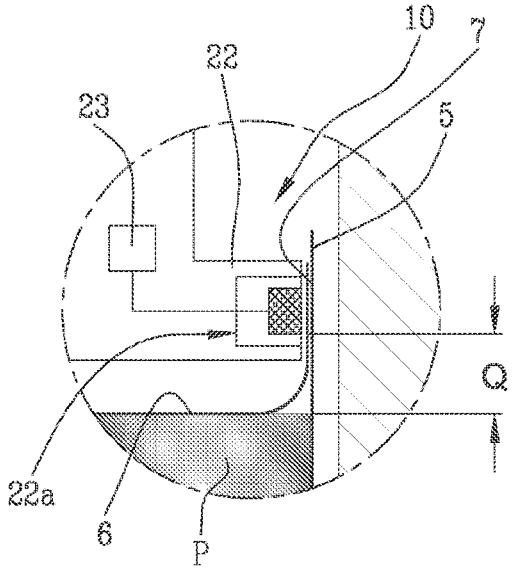
FIG. 7 illustrates an enlarged detail of FIG. 4.

In the case illustrated in FIG. 7, the perimeter edge 5 of the tray has a height, from the covering surface, which is greater than the edge 7 of the lid 6 so that, after the step of folding the two edges 5, 7 onto the covering surface of the lid 6, an outer portion of the edge 5 of the tray, on its inner side, that is, the one in contact with the creamy product P, lies in contact with the outer side, that is, the one not in contact with the creamy product P, of the covering surface of the lid 6.

Substantially, the free edge of the tray may have a height greater than the edge of the lid 6, so, after the step of folding the lid 6 towards the covering surface, a portion of the free edge (the inner side of it) of the tray comes into contact with the covering surface of the lid (on the outer side of the latter).

FIGS. 9 to 16 show a tray and the lid 6 having a perimeter (more specifically, the corresponding raised edges 5 and 7) which are polygonal in shape (in this case square, but it might also have the shape of a triangle, rectangle, etc.).

With this geometry of the package, the sub-step of partial sealing only occurs close to the corners joining the sides of the raised and facing edges 5 and 7 of the tray and lid 6.

Figure 8:
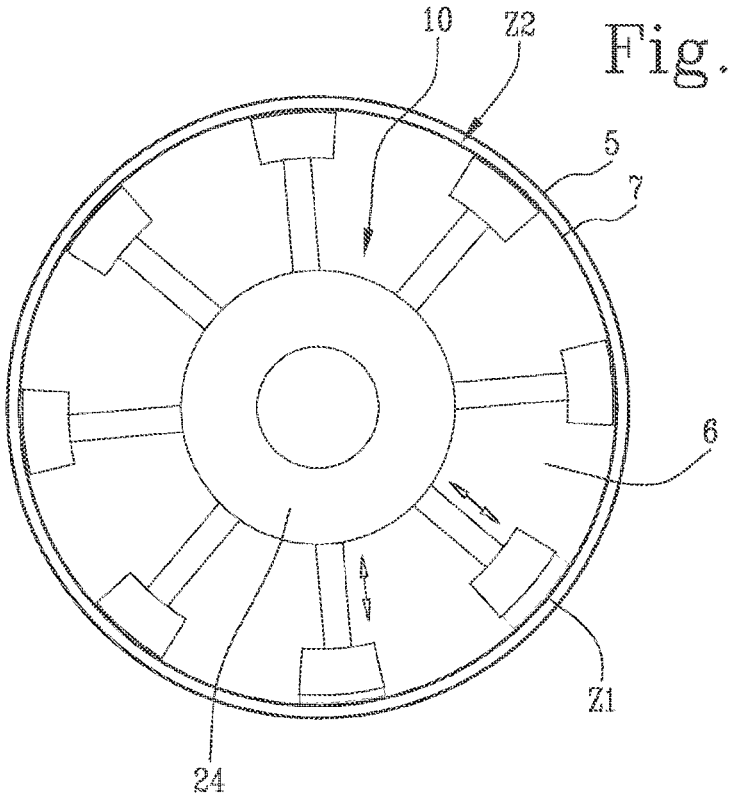
FIG. 8 is a schematic top plan view, with some parts cut away to better illustrate others, of a step for partial sealing of the method according to the invention.

As illustrated in FIG. 8, the package 1 might have a circular perimeter shape (or ellipsoid shape, depending on production requirements), so the tray and the second piece 6 have a circular or ellipsoid perimeter (of the corresponding raised edges 5 and 7.

With this geometry, the sub-step of partial sealing occurs along curved, and limited, stretches of the raised and facing edges 5 and 7 of the tray and lid 6.

Preferably, the curved zones Z1 may be alternated in a constant fashion with non-sealed zones Z2 (see FIG. 8), but this does not mean that the alternating cannot be differentiated in a constant manner with respect to that illustrated in FIG. 8.

It should be noted that the partial sealing sub-step is obtained by sealing (by means of a partial sealing device 10) the raised and facing edges 5 and 7 of the tray and of the lid 6 starting from a predetermined height Q relative to the covering surface formed by the lid 6 resting on the creamy product P (see FIG. 7), so as not to seal the zone between the covering surface and the predetermined height Q.

In light of this, the first partial seal is made at an intermediate height between the upper end of the edge 7 of the lid 6 and the corner joining the edge 7 with the covering surface of the lid 6.

Preferably, both the partial sealing sub-step and the complete sealing sub-step are carried out hot and at an operating temperature of not less than 100° C.

Preferably, the sub-step of final sealing of the folded perimeter edges 5, 7 is performed by keeping the creamy product P contained in the tray pressed.

In light of this, the sub-step of pressing the creamy product P contained in the partly sealed tray is performed with a pressure exerted only on the folded perimeter edges 5, 7 on the covering surface of the lid 6, leaving a central zone unpressed.

The first piece 2 and the second piece 6 are preferably made of material with heat-sealing characteristics. More specifically, at least the inner surface of the first and second pieces 2 and 6 are treated with lacquers which are able to give said inner surfaces heat-sealing characteristics.

The invention also comprises an apparatus for forming the package 1 for creamy products.

As illustrated, the apparatus comprises a first forming device 3 configured to form a tray by folding a first piece 2 of wrapping material which is able to define a base 4 and at least one continuous perimeter edge 5 extending perpendicular to the base 4 (FIGS. 1 and 9).

In the case illustrated, by way of example, the device 3 comprises a forming hopper 14 located above a conveyor 15 (with a linear or circular path) equipped with a plurality of open cavities or seats 16 in which the respective open trays are formed and positioned to allow the trays to reach in sequence the further zones for completing the package 1.

The forming of the tray in the hopper 14 is achieved with a piston 17 movable along the opening of the hopper 14.

The apparatus also comprises an element 30 (dispensing nozzle) for filling the tray and configured to dispense the creamy product P at a predetermined rate in the tray (FIGS. 2 and 10).

The apparatus comprises a second device 11 (for example, a second forming hopper 18 with a relative piston 19) configured to form a lid by folding a second piece 6 of wrapping material and placing the lid thus formed on the creamy product in the tray.

In this way, the lid forms a covering surface lying on the creamy product and a perimeter edge 7 positioned to face the free perimeter edge 5 of the tray (FIGS. 3 and 11).

The apparatus also comprises a station 12 for hermetic sealing of the lid to the tray.

As illustrated, the sealing station 12 comprises a device 10 for partial sealing of the facing perimeter edges 5 and 7 of the tray and of the lid 6 configured to perform a sealing of at least one perimeter zone Z1 of the edges 5 and 7 facing each other.

Figure 4:
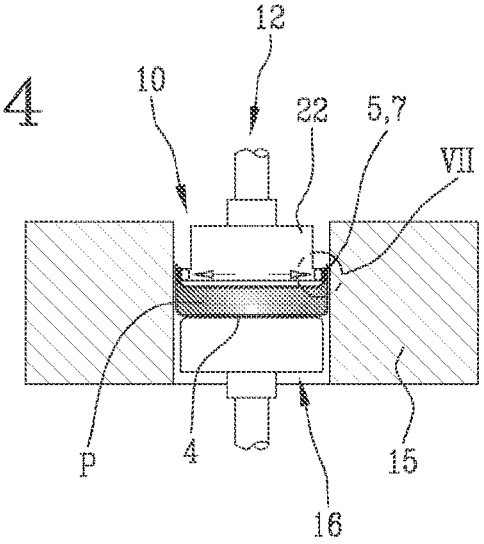
Figure 13:
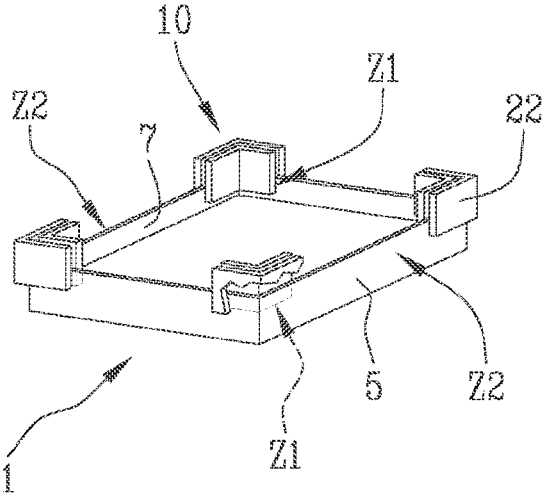

It should be noted that the first zone Z1 covers in its entirety a limited perimeter portion of the facing edges 5, 7 of the tray and of the lid 6 in such a way as to leave at least a second perimeter zone Z2 of the unsealed edges 5, 7 in communication with the creamy product contained in the tray (FIGS. 4 and 13).

Again as illustrated, the sealing station 12 comprises a folding element 8 configured to fold the facing perimeter edges 5 and 7 of the lid 6 and of the tray on the covering surface of the lid 6. The folding element 8 is configured to be actuated after the partial sealing has been performed with the partial sealing device 10 (FIGS. 5 and 14).

Again as illustrated, the sealing station 12 comprises a pressing device and a device for sealing complete of the folded perimeter edges 5 and 7. The pressing and complete sealing devices being configured so as to be actuated after the folding of the facing perimeter edges 5, 7 of the lid 6 and of the tray with the folding element 8 so as to define a complete sealing of the package 1 obtained (FIGS. 6, 15 and 16).

It should be noted that the device 10 for partial sealing of the opposite perimeter edges 5 and 7 of the tray and of the cover 6 comprises a sealing plate 22 having a heated discontinuous track (with suitable heating unit 23), that is, only predetermined stretches of the track are sealed.

In light of this, the discontinuous track could be equipped with a translation unit 22*a* for moving the heated stretches towards and away from the facing edges 5 and 7. In a first embodiment, the folding unit 8 comprises a series of walls 21 which are movable preferably horizontally in both directions to allow the folding of the partly sealed edges 5 and 7.

The pressing device and the complete sealing device comprise a plate 29 having a continuous track on the heated lower surface to allow the pressing of the product and the complete sealing of the folded edges 5 and 7 and the relative sealing of the package.

Preferably, the pressing device and the complete sealing device consist of a shared pressing-sealing device 9 configured to expel the air from the inside of the tray and completely seal the folded perimeter edges 5, 7.

In light of this, the pressing-sealing device 9 is operated in such a way as to perform the complete sealing while the creamy product P contained in the tray is kept pressed.

In a first embodiment, the tray and the lid 6 may have the perimeter of the corresponding facing edges 5 and 7 which are polygonal in shape (square, quadrangular, etc.).

In this case, the partial sealing device 10 (with a shape matching the shape of the raised edges 5 and 7) is configured in such a way as to perform a partial sealing only in the proximity of the corners of the facing edges 5 and 7 of the lid 6 and of the tray.

It should be noted that if the tray and the lid 6 have a perimeter of the corresponding facing edges which is circular or ellipsoid, the partial sealing device 10 has a shape matching the shape of the edges 5 and 7 and is configured in such a way as to define a plurality of curved and limited sealed zones Z1, of the facing edges 5 and 7 of the tray and lid 6.

As illustrated in FIG. 8, a circular plate 24 is equipped with a set of heated semi-circular portions which are translatable towards and away from the facing edges 5 and 7 in such a way as to partly seal the facing edges 5 and 7 of the tray and of the lid 6.

In terms of construction, the partial sealing device 10 comprises a pair of sealing units configured to be actuated towards each other along a direction parallel to the base 4 of the tray, whilst the pressing and complete sealing devices are configured to be actuated along a direction perpendicular to the base 4 of the tray.

Figure 13B:
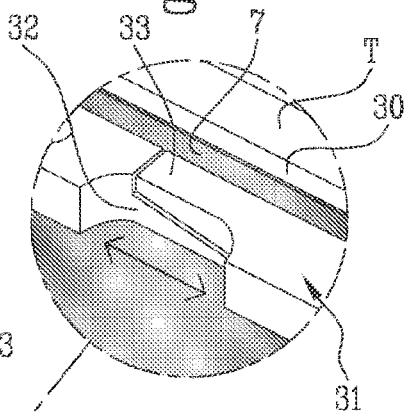
FIG. 13*b* shows an enlarged detail of FIG. 13*a* which shows a part of the partial sealing device in a non-operating position.
Figure 13A:
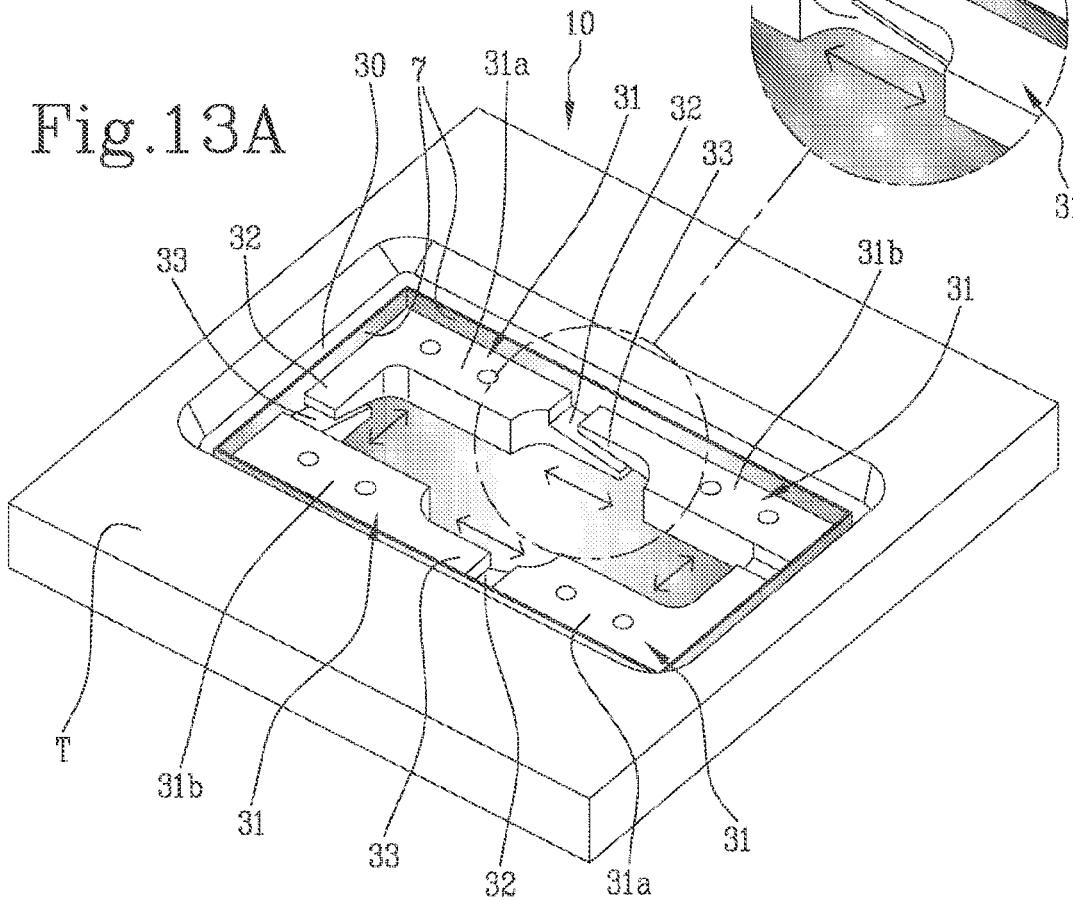
FIG. 13*a* is a schematic perspective view, with some parts cut away, of an embodiment of a device for partly sealing the package in an operating position.

Preferably (see FIGS. 13*a* and 13*b*), the partial sealing device 10 comprises at least one fixed sealing element 30 and a sealing element 31 movable between a position away from the fixed sealing element 30 and a position close to the fixed sealing element 30 with the perimeter edges 5, 7 facing the tray and the lid 6 interposed between them.

The fixed sealing element 30 is located stationary outside the tray whilst the movable sealing element 31 is configured to be actuated away from/towards the fixed sealing element 30 from the inside of the tray.

In light of this, the fixed sealing element 30 consists of a single element configured to encircle the facing perimeter edges 5, 7 of the tray and of the lid 6, whilst the movable sealing element 31 comprises a plurality of movable sealing elements which are configured to operate in conjunction with the fixed sealing element 30 and are of a size such as to leave unsealed zones between them when they are close to the fixed sealing element 30.

It should be noted that (in an example embodiment of quadrangular packages), the fixed sealing element 30 is part of a perimeter supporting frame T.

The movable sealing units 31 may comprise two pairs of plates 31*a* and 31*b* with angled sealing heads.

Each plate 31*a*, 31*b* has the corresponding ends tapered to define inclined surfaces 32, 33 complementary to and facing the inclined surfaces 33, 32 of the plates contiguous thereto in order to complete the perimeter configuration of the fixed sealing element 30.

The inclined surfaces 32, 33 of the plates 31*a*, 31*b* allow the plates to slide in both directions along trajectories which are also transversal to each other and simultaneously move away from/towards the fixed sealing element 30 from the inside of the tray.

As mentioned, each plate 31*a* and 31 has at least two outer side surfaces heated and contiguous and angled to allow the sealing of the corners of the edges 5, 7, whilst the remaining surfaces are inactive and form only parts of the frame of the plates or the tapered ends.

The packaging method and the relative apparatus structured in this way fully achieve the preset aims thanks to the sealing of the edges alongside each other divided into two steps separate from each other.

The partial sealing step makes it possible to stabilise the reciprocal position of the edges whilst keeping zones of the edges still relatively free or open.

The pressing step allows escape of any air from the inside of the tray and substantially simultaneously the edges are completely sealed with the complete sealing step.

There are advantages with this system such as greater security of internal seal of the package and a linear and compact closure of the entire perimeter edge.

The invention claimed is:

1. A method for forming a package for creamy products comprising the following steps:

forming a tray starting from a first piece of wrapping material by folding the first piece to form a base and a continuous perimeter edge extending substantially perpendicular to the base;

dosing a predetermined quantity of creamy product inside the tray formed;

forming a lid for closing a top opening of the tray starting from a second piece of wrapping material by folding the second piece to define a covering surface and a raised perimeter edge which extends substantially perpendicular from the covering surface;

inserting the lid into the tray placing the covering surface in contact with the creamy product positioned in the tray and the raised perimeter edge of the lid facing the perimeter edge of the tray;

sealing by sealing the lid to the tray;

wherein the sealing step comprises the following sub-steps:

partially sealing the perimeter edges facing each other of the tray and of the lid to define at least a first perimeter zone of the perimeter edges sealed to each other and at least a second perimeter zone of the perimeter edges not sealed and communicating with the creamy product contained in the tray; after the partially sealing steps:

folding the facing perimeter edges of the tray and the lid on the covering surface of the lid; and lastly pressing the creamy product contained in the partly sealed tray for expelling any air present in the tray; and finally sealing the perimeter edges folded on the covering surface of the lid to obtain a complete sealing of the package obtained.

2. The method according to claim 1, wherein the step of forming the lid forms a perimeter edge of the lid with a height such that when the lid is rested on the creamy product inside the tray, the perimeter edge of the lid is placed over the perimeter edge of the tray.

3. The method according to claim 2, wherein the perimeter edge of the tray is at a height, above the covering surface, which is greater than the perimeter edge of the lid so that, after the step of folding the two perimeter edges onto the covering surface of the lid, an outer portion of the perimeter edge of the tray, on an inner side in contact with the creamy product, lies in contact with an outer side not in contact with the creamy product, of the covering surface of the lid.

4. The method according claim 1, wherein the tray and the lid have a perimeter with a polygonal shape and wherein the sub-step of partially sealing occurs only close to corners joining the sides of the raised and facing perimeter edges of the tray and the lid.

5. The method according to claim 1, wherein the tray and the lid have a circular or ellipsoid shaped perimeter, and wherein the sub-step of partially sealing occurs along curved and limited stretches of the raised and facing perimeter edges of the tray and of the lid.

6. The method according to claim 1, wherein the sub-step of partially sealing is obtained by sealing the raised and facing perimeter edges of the tray and lid starting from a predetermined height relative to the covering surface of the lid resting on the creamy product, so as not to seal the zone between the covering surface and said predetermined height.

7. The method according to claim 1, wherein the sub-step of partially sealing and/or the sub-step of finally sealing occurs hot and at an operating temperature of not less than 100° C.

8. The method according to claim 1, wherein the sub-step of finally sealing of the folded perimeter edges is performed by pressing the creamy product contained in the tray.

9. The method according to claim 1, wherein the sub-step of pressing the creamy product contained in the partly sealed tray is performed with a pressure exerted only on the folded perimeter edges on the covering surface of the lid, leaving a central zone unpressed.

10. An apparatus for forming a package for creamy products comprising at least:

a first forming device configured to form a tray by folding a first piece of wrapping material which is able to define a base and at least one continuous perimeter edge extending perpendicular to the base;

an element for dispensing a creamy product in the tray and configured to dispense a predetermined dose of the creamy product in the tray;

a second forming device configured to form a lid by folding a second piece of wrapping material and placing the lid on the creamy product located in the tray, said lid defining a covering surface lying on the creamy product and a perimeter edge positioned to face the perimeter edge of the tray;

a station for sealing the lid to the tray;

wherein the sealing station comprises at least:

a partial sealing device for performing a partial sealing the facing perimeter edges of the tray and lid and configured to seal at least one first perimeter zone of the perimeter edges facing each other, said at least one first perimeter zone covering in its entirety a limited perimeter portion of the facing perimeter edges of the tray and of the lid such as to leave at least a second perimeter zone of the unsealed perimeter edges in communication with the creamy product contained in the tray;

a folding element configured for folding the facing perimeter edges of the lid and of the tray on the covering surface of the lid, said folding element being configured to be actuated after the partial sealing with said partial sealing device has been performed;

a pressing device and a complete sealing device for performing a complete sealing of the folded perimeter edges, said pressing and complete sealing devices being configured, respectively, for pressing the creamy product into the tray to expel any air still present in the tray and to completely seal the folded perimeter edges to obtain a sealed package, said pressing and complete sealing devices being configured to be actuated after the folding of the facing perimeter edges of the lid and of the tray with said folding element.

11. The apparatus according to claim 10, wherein the tray and the lid have a perimeter of the corresponding facing perimeter edges which is polygonal in shape and wherein the partial sealing device is configured to perform the partial sealing only in proximity to corners of the facing perimeter edges of the tray and of the lid.

12. The apparatus according to claim 10, wherein the pressing device and the complete sealing device consist of a shared pressing-sealing device configured to expel the air from inside of the tray and completely seal the folded perimeter edges, said complete sealing device being actuated to perform the complete sealing while the creamy product contained in the tray is held pressed.

13. The apparatus according to claim 10, wherein the partial sealing device comprises a pair of sealing units configured to be actuated towards each other along a direction parallel to the base of the tray, whilst said pressing and complete sealing devices are configured to be actuated along a direction perpendicular to the base of the tray.

14. The apparatus according to claim 10, wherein the partial sealing device comprises at least one fixed sealing element and a movable sealing element movable between a position away from the fixed sealing element and a position close to the fixed sealing element with interposed the facing perimeter edges of the tray and of the lid, the fixed sealing element positioned stationary outside the tray, while the movable sealing element is configured to be actuated away from/towards the fixed sealing element from inside of the tray.

15. The apparatus according to claim 14, wherein the fixed sealing element consists of a single element configured to encircle the facing perimeter edges of the tray and of the lid, while the movable sealing element comprises a plurality of movable sealing elements which are configured to operate in conjunction with the fixed sealing element and are of a size to leave unsealed zones between the movable sealing elements when the movable sealing elements are close to the fixed sealing element.

* * * * *